US009580877B2

(12) United States Patent
Shin

(10) Patent No.: US 9,580,877 B2
(45) Date of Patent: Feb. 28, 2017

(54) DELINEATOR POST HAVING RESTORATION FUNCTION

(71) Applicant: KOTRASS CO., LTD., Gwangju-si, Gyeonggi-do (KR)

(72) Inventor: Hyun Soo Shin, Gwangju-si (KR)

(73) Assignee: KOTRASS CO., LTD., Gwangju-si (KR)

( * ) Notice: Subject to any disclaimer, the term of this patent is extended or adjusted under 35 U.S.C. 154(b) by 0 days.

(21) Appl. No.: 14/773,701

(22) PCT Filed: Mar. 7, 2014

(86) PCT No.: PCT/KR2014/001915
§ 371 (c)(1),
(2) Date: Sep. 8, 2015

(87) PCT Pub. No.: WO2014/137198
PCT Pub. Date: Sep. 12, 2014

(65) Prior Publication Data

US 2016/0040374 A1 Feb. 11, 2016

(30) Foreign Application Priority Data

Mar. 8, 2013 (KR) ..... 10-2013-0024801

(51) Int. Cl.
*E01F 9/00* (2016.01)
*E01F 9/017* (2006.01)

(52) U.S. Cl.
CPC ..... *E01F 9/0175* (2013.01); *E01F 9/629* (2016.02); *E01F 9/681* (2016.02)

(58) Field of Classification Search
CPC ..... E01F 9/011; E01F 9/045; E01F 9/076; E01F 9/0175; E01F 9/0177; E01F 9/0111; E01F 9/681; E01F 9/629
See application file for complete search history.

(56) References Cited

U.S. PATENT DOCUMENTS 3,478,714 A * 11/1969 Keats ..... E01F 9/0175 116/63 P
3,799,686 A * 3/1974 Williams ..... E01F 9/0175 404/10

(Continued)

FOREIGN PATENT DOCUMENTS

CN 202766990 U 3/2013
JP 09-279535 A 10/1997

(Continued)

OTHER PUBLICATIONS

International Search Report dated Jun. 25, 2014 of PCT/KR2014/001915 which is the parent application and its English translation—4 pages.

*Primary Examiner* — Abigail A Risic
(74) *Attorney, Agent, or Firm* — Knobbe Martens Olson & Bear LLP

(57) ABSTRACT

A delineator post with a restoration function includes a base panel, a delineator body fixed to the base panel and a tubular elastic band connecting the base panel and the delineator body. The delineator body has a disposition space formed therein. The tubular elastic band extends from the base panel to the top of the delineator body through the disposition space. The delineator post further includes a restoration rod having an upper portion inserted into the disposition space of the delineator body and capable of restoring the delineator body. In this configuration, when the delineator post is tilted by an external force caused by a vehicle or laid down by being trampled by a tire of a vehicle, the delineator post may restore its original shape by the above configuration of the restoration rod.

9 Claims, 6 Drawing Sheets

(56) References Cited

U.S. PATENT DOCUMENTS

| | | | | | |
|---|---|---|---|---|---|
| 4,004,545 | A * | 1/1977 | O'Donnell | E01F 9/0175 | 116/63 P |
| 4,290,585 | A * | 9/1981 | Glaesener | E01F 15/146 | 256/13.1 |
| 4,343,567 | A * | 8/1982 | Sarver | 116/209 | |
| 4,522,530 | A * | 6/1985 | Arthur | E02D 5/80 | 40/608 |
| 4,571,118 | A * | 2/1986 | Schmanski | E01F 13/06 | 116/63 R |
| 5,066,163 | A * | 11/1991 | Whitaker | E01F 9/0117 | 256/19 |
| 5,205,236 | A * | 4/1993 | Hughes | E01F 9/0175 | 116/209 |
| 5,452,965 | A * | 9/1995 | Hughes, Sr. | E01F 9/0111 | 404/10 |
| 5,908,262 | A * | 6/1999 | Ahn | E01F 9/0115 | 116/63 P |
| 2016/0032544 | A1* | 2/2016 | Landes | E01F 9/019 | 404/10 |

FOREIGN PATENT DOCUMENTS

| | | | |
|---|---|---|---|
| KR | 20-0207047 | Y1 | 12/2000 |
| KR | 20-0265857 | Y1 | 2/2002 |
| KR | 20-0381780 | Y1 | 4/2005 |
| KR | 20-0430992 | Y1 | 11/2006 |
| KR | 10-0756544 | B1 | 9/2007 |
| KR | 20-2012-0008797 | U | 12/2012 |

* cited by examiner

DELINEATOR POST HAVING RESTORATION FUNCTION

TECHNICAL FIELD

The present disclosure relates to a delineator post having a restoration function, in which a delineator body tilted by an external force caused by a vehicle or laid down by being trampled by a tire of a vehicle may restore its original shape.

The present application claims the benefit of Korean Patent Application No. 10-2013-0024801 filed on Mar. 8, 2013 with the Korean Intellectual Property Office, the disclosure of which is incorporated herein by reference in its entirety.

BACKGROUND ART

Generally, delineator posts (including road studs) are frequently disposed at a center of a road, a lane of a dangerous pedestrian section, or the like. The delineator post helps a driver to secure a view at night when it rains, allows a driver to recognize that he drives over a centerline by mistake such as dozing, and also protects pedestrians in a pedestrian section.

An existing delineator post includes a bottom plate fixed to the ground surface by anchor bolts or the like, and a rod-shaped body protruding upwards from a center of an upper portion of the bottom plate to a predetermined height from the ground surface, and the bottom plate and the rod-shaped body have an integrated structure and are generally made of synthetic resin by injection molding.

In addition, the body has a circular or polygonal shape, and a reflecting body is installed at a side of the body. Also, the bottom plate has a plate shape with a gentle slope, which has a narrow top and a broad bottom, so that the delineator post may be stably supported on the ground surface.

However, if a vehicle is bumped against the body of the existing delineator post or the body is trampled by a tire of a vehicle, the body may be pulled out from the bottom plate and then separated or broken.

DISCLOSURE

Technical Problem

The present disclosure is designed to solve the problems of the related art, and therefore the present disclosure is directed to providing a delineator post with a restoration function, which has an improved structure so that a delineator body tilted by an external force caused by a vehicle or laid down by being trampled by a tire of a vehicle may restore its original shape.

Technical Solution

In one aspect of the present disclosure, there is provided a delineator post with a restoration function, which includes a base panel having a coupling hole formed therethrough and installed at the ground; a delineator body installed at an upper portion of the base panel and having a disposition space formed therein; and a restoration rod having an upper portion inserted into the disposition space of the delineator body through the coupling hole and a lower portion coupled to the coupling hole, the restoration rod being capable of restoring the delineator body tilted by an external force.

Preferably, the delineator post may further include at least one elastic member accommodated in the disposition space of the delineator body to elastically connect the base panel to the delineator body.

Preferably, the delineator body may include at least one pair of connection holes formed through an upper portion thereof to communicate with the disposition space, the base panel may further include at least one pair of coupling holes formed therethrough, and the at least one elastic member may have one end fixed to any one of the at least one pair of coupling holes through any one of the at least one pair of connection holes and the other end fixed to the other one of the at least one pair of coupling holes through the other one of the at least one pair of connection holes.

Preferably, the at least one elastic member may be made of elastic hoses whose both ends are insertable into the at least one pair of coupling holes, and screw portions are respectively formed at inner sides of the at least one pair of coupling holes so that screws may be coupled thereto, and screws may be respectively coupled to the at least one pair of coupling holes so that both ends of the at least one elastic member inserted into the at least one pair of coupling holes are interposed between the at least one pair of coupling holes and the screws, thereby fixing both ends of the at least one elastic member to the at least one pair of coupling holes, respectively.

Preferably, both ends of the at least one elastic member may extend through the at least one pair of coupling holes, respectively, and the at least one elastic member may include a pair of knots for knotting both ends thereof so that both ends extending through the at least one pair of coupling holes do not deviate through the at least one pair of coupling holes.

Preferably, the base panel may further include an extension provided at a bottom surface thereof and formed with a tilted groove structure communicating with the coupling hole, and the restoration rod may include a hooking portion provided at a lower portion thereof and having a tilted outer side to be hooked by the extension.

Preferably, the base panel may further include at least one fixing groove provided at a bottom surface thereof and formed by cutting a part of the base panel to communicate with the coupling hole, and the restoration rod may include a fixing pin coupled to a lower portion thereof and inserted into and hooked by the at least one fixing groove.

Preferably, the base panel may further include a protrusion formed at a top surface thereof and inserted into the delineator body.

Preferably, the restoration rod may include an elastic rod coupled to an upper portion thereof to give an elastic force for restoring the delineator body tilted by an external force.

Preferably, the restoration rod may be made of synthetic resin of urethane material, and the elastic rod may be formed by impregnating a composite material with synthetic resin.

Preferably, the composite material may be glass fiber.

Advantageous Effects

The delineator post with a restoration function according to the present disclosure has the following effects.

First, since a restoration rod is installed at a base panel and a delineator body is installed at an upper portion of the base panel so that the restoration rod is inserted into a disposition space in the delineator body, the delineator body may restore its original shape even though it is tilted by an external force caused by a vehicle or laid down by being trampled by a tire of a vehicle.

Second, since the base panel and the delineator body are connected to each other by using an elastic member, it is possible to prevent the restoration rod from escaping from the disposition space of the delineator body, and the delineator body tilted or laid down may restore its original shape more effectively by means of the elastic force of the elastic member.

EMBODIMENTS

Figure 1:
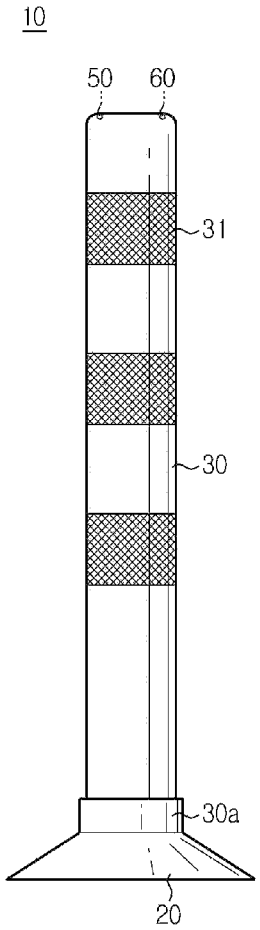
FIG. 1 is a front view showing a delineator post having a restoration function according to the first embodiment of the present disclosure.

Hereinafter, a delineator post with a restoration function according to an embodiment of the present disclosure will be described in detail with reference to the accompanying drawings. Here, line thicknesses or sizes of components depicted in the drawings may be exaggerative for convenience or better explanation. In addition, the terms used herein are defined in consideration of functions in the present disclosure and may be changed according to the intention of users or operators or according to custom. Therefore, the terms should be defined based on the whole disclosure of this specification.

In addition, the following embodiment is not intended to limit the scope of the present disclosure but is proposed just as an example, and various embodiments may be implemented from the present disclosure.

Figure 2:
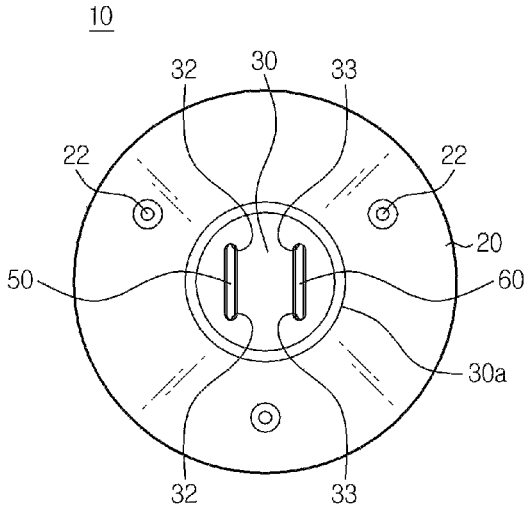
FIG. 2 is a plane view showing the delineator post having a restoration function according to the first embodiment of the present disclosure.
Figure 3:
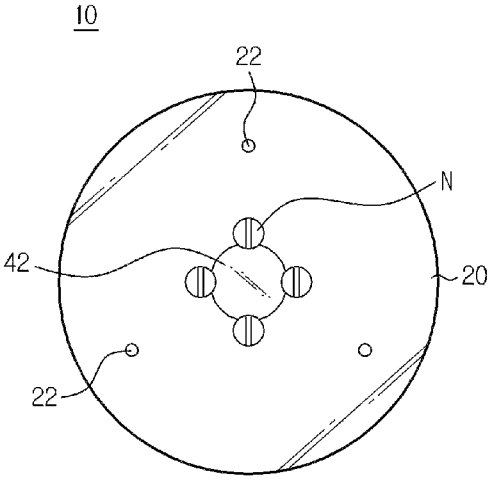
FIG. 3 is a bottom view showing delineator post having a restoration function according to the first embodiment of the present disclosure.

FIG. 1 is a front view showing a delineator post having a restoration function according to the first embodiment of the present disclosure, FIG. 2 is a plane view showing the delineator post having a restoration function according to the first embodiment of the present disclosure, and FIG. 3 is a bottom view showing delineator post having a restoration function according to the first embodiment of the present disclosure.

Figure 4:
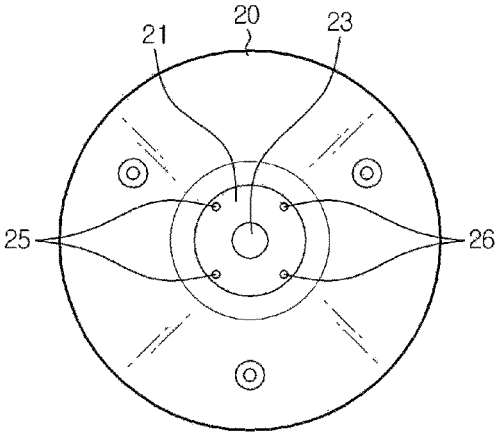
FIG. 4 is a plane view showing a base panel employed in the delineator post having a restoration function according to the first embodiment of the present disclosure.
Figure 5:
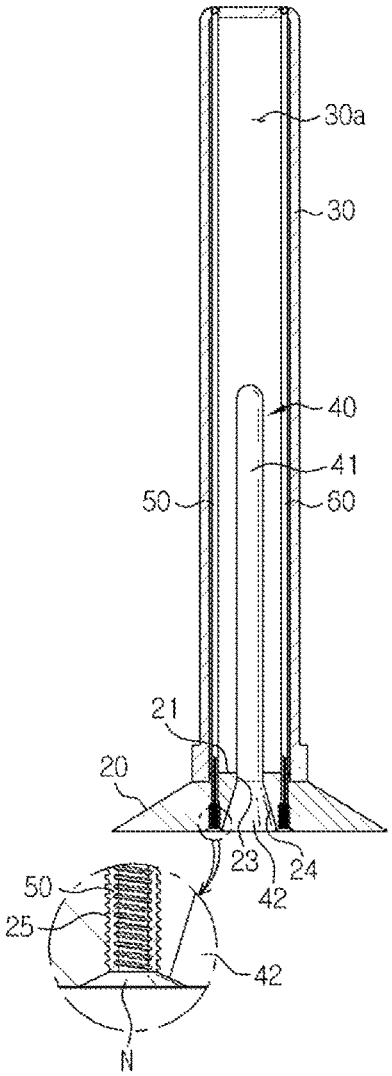
FIG. 5 is a cross-sectional view showing the delineator post having a restoration function according to the first embodiment of the present disclosure.

In addition, FIG. 4 is a plane view showing a base panel employed in the delineator post having a restoration function according to the first embodiment of the present disclosure, and FIG. 5 is a cross-sectional view showing the delineator post having a restoration function according to the first embodiment of the present disclosure.

Referring to FIGS. 1 to 5, a delineator post 10 having a restoration function according to the first embodiment of the present disclosure is installed on a road to control entry of vehicles and includes a base panel 20, a delineator body 30, and/or a restoration rod 40.

The base panel 20 is made of synthetic resin. A protrusion 21 is formed on a top surface of the base panel 20 so that the delineator body 30 may be inserted therein. A plurality of fixing holes 22 are formed at a periphery of the base panel 20 so that anchor bolts may be coupled thereto. Therefore, the base panel 20 may be fixed to the ground by coupling anchor bolts to the plurality of fixing holes 22. An upper rim of the protrusion 21 may be formed with a rounded shape so that the delineator body 30 is not caught by the protrusion 21 while the delineator body 30 restores its original shape from a tilted state.

A coupling hole 23 is formed at the center of the base panel 20 through a top surface and a bottom surface of the base panel 20. An extension 24 having a tilted groove structure communicating with the coupling hole 23 is formed at the bottom surface of the base panel 20.

The delineator body 30 is made of synthetic resin. The lower portion of the delineator body 30 is open so that the protrusion 21 of the base panel 20 may be inserted therein. A disposition space 30*a* is formed in the delineator body 30. A plurality of reflecting strips 31 are attached to an outer circumference of the delineator body 30 at regular intervals. A driver may recognize the delineator post 10 by means of light of a vehicle or the like, reflected by the plurality of reflecting strips 31.

A support frame 30*a* may be attached or welded to the lower portion of the delineator body 30. Therefore, a contact area between the bottom surface of the delineator body 30 and the top surface of the base panel 20 is increased by the support frame 30*a*, so that the delineator body 30 may more stably disposed to stand upright on the ground.

The restoration rod 40 is made of synthetic resin of urethane material with a restoring property and/or an elastic property. A protrusion 41 is formed on an upper portion of the restoration rod 40 to protrude above the base panel 20 through the coupling hole 23 of the base panel 20, so that the protrusion 41 may be inserted into the disposition space 30*a* of the delineator body 30. The lower portion of the restoration rod 40 is inserted to be hooked by the extension 24 of the base panel 20. The restoration rod 40 may restore the delineator body 30 tilted by an external force.

A hooking portion 42 having a tilted outer side, which is inserted to be hooked by the extension 24 of the base panel 20, is formed at a lower portion of the restoration rod 40. A hooking groove 421 is formed at a lower portion of the hooking portion 42. The protrusion 41 and the hooking portion 42 of the restoration rod 40 may be integrally formed by injection molding.

The hooking portion 42 coupled to the extension 24 of the base panel 20 as described above is formed to have a slope corresponding to the extension 24. Therefore, the hooking portion 42 of the restoration rod 40 inserted into the extension 24 of the base panel 20 may be pulled out below the base panel 20 so that the restoration rod 40 is separated from the base panel 20, thereby facilitating easier maintenance.

Meanwhile, the restoration rod 40 may restore the delineator body 30 tilted by an external force, but if a strong external force is applied to the delineator body 30, the protrusion 41 of the restoration rod 40 inserted into the disposition space 30*a* of the delineator body 30 may deviate from the disposition space 30*a* of the delineator body 30. If the protrusion 41 of the restoration rod 40 deviates from the disposition space 30*a* of the delineator body 30, the restoration rod 40 is not able to restore the delineator body 30 anymore.

To solve this problem, the delineator post 10 having a restoration function according to the first embodiment of the present disclosure may further include at least one elastic member accommodated in the disposition space 30*a* of the delineator body 30 and elastically connecting the base panel 20 to the delineator body 30. The number of elastic members, which may be installed at the delineator post 10, is not specially limited. Hereinafter, it will be described as an example that two elastic members, namely a first elastic member 50 and a second elastic member 60, are installed.

In order to install the first elastic member 50, a pair of first connection holes 32 may be formed through the upper portion of the delineator body 30 to communicate with the disposition space 30*a*, and a pair of first coupling holes 25 may be formed through the base panel 20. The first elastic member 50 may have one end fixed to any one of the pair of first coupling holes 25 through any one of the pair of first connection holes 32, and the other end fixed to the other of the pair of first coupling holes 25 through the other of the pair of first connection holes 32, in order to connect the pair of first connection holes 32. In other words, the first elastic member 50 may be bent into a U shape so that a central bent portion is supported by the top surface of the delineator body 30, and both ends of the first elastic member 50 may be fixed to the pair of first coupling holes 25, respectively, to elastically connect the delineator body 30 to the base panel 20.

The first elastic member 50 may be installed in any way. For example, an elastic hose made of synthetic resin with elasticity and having both ends inserted into the pair of first coupling holes 25 may be used as the first elastic member 50. Also, screw portions to which screws N may be coupled and fixed may be formed at inner sides of the pair of first coupling holes 25. Therefore, screws N may be respectively coupled to the pair of first coupling holes 25 so that both ends of the first elastic member 50 respectively inserted into the pair of first coupling holes 25 are interposed between the pair of first coupling holes 25 and the screws N, thereby fixing both ends of the first elastic member 50 to the pair of first coupling holes 25, respectively. If the first elastic member 50 is installed as described above, the delineator body 30 tilted by an external force may be restored to stand upright on the ground by means of the elasticity of the first elastic member 50.

In addition, in order to install the second elastic member 60, a pair of second connection holes 33 may be formed through the upper portion of the delineator body 30 to communicate with the disposition space 30*a*, and a pair of second coupling holes 26 may be formed through the base panel 20. The second elastic member 60 may have one end fixed to any one of the pair of second coupling holes 26 through any one of the pair of second connection holes 33 and the other end fixed to the other of the pair of second coupling holes 26 through the other of the pair of second connection holes 33, in order to connect the pair of second connection holes 33. In other words, the second elastic member 60 may be bent into a U shape so that its central bent portion is supported by the top surface of the delineator body 30, and both ends of the second elastic member 60 may be fixed to the pair of second coupling holes 26, thereby elastically connecting the delineator body 30 to the base panel 20.

The second elastic member 60 may be installed in any way. For example, an elastic hose made of synthetic resin with elasticity and having both ends inserted into the pair of second coupling holes 26 may be used as the second elastic member 60. Also, screw portions to which screws N may be coupled and fixed may be formed at inner sides of the pair of second coupling holes 26. Therefore, screws N may be respectively coupled to the pair of second coupling holes 26 so that both ends of the second elastic member 60 respectively inserted into the pair of second coupling holes 26 are interposed between the pair of second coupling holes 26 and the screws N, thereby fixing both ends of the second elastic member 60 to the pair of second coupling holes 26, respectively. If the second elastic member 60 is installed as described above, the delineator body 30 tilted by an external force may be restored to stand upright on the ground by means of the elasticity of the second elastic member 60.

Here, the screws N may be inserted into ends of the first and second elastic members 50, 60 inserted into the first and second coupling holes 25, 26 so that the ends of the first and second elastic members 50, 60 are fitted to the screw portions of the first and second coupling holes 25, 26 while being pressed toward the screw portions of the first and second coupling holes 25, 26, thereby firmly fixing the first and second elastic members 50, 60. In addition, the screw N may be coupled so that one side of its head is hooked by the hooking groove 421 of the restoration rod 40, thereby fixing the hooking groove 421 of the restoration rod 40. Preferably, extended coupling portions may be formed at the lower portions of the first and second coupling holes 25, 26 so that screw heads are inserted therein, and the screws N may be coupled to the first and second coupling holes 25, 26 so that the screw heads are inserted into the extended coupling portions.

Meanwhile, a pair of elongated grooves may be formed in the upper portion of the delineator body 30, and a first connection hole 32 and a second connection hole 33 may be respectively formed at the pair of elongated grooves. Therefore, it is possible to prevent the first elastic member 50 and the second elastic member 60 respectively coupled to the first connection hole 32 and the second connection hole 33 from protruding out at the top surface of the delineator body 30.

Hereinafter, an installation process of the delineator post 10 configured as above according to the first embodiment of the present disclosure will be described.

First, anchor bolts are installed at the ground.

Next, the protrusion 21 of the base panel 20 is inserted into the open lower portion of the delineator body 30 so that the protrusion 41 of the restoration rod 40 is inserted into the disposition space 30*a* of the delineator body 30.

After that, the base panel 20 and the delineator body 30 are elastically connected by means of the first and second elastic members 50, 60, and then the first and second elastic members 50, 60 and the base panel 20 are coupled and fixed to each other by screws.

Next, anchor bolts are connected to the fixing hole 22 of the base panel 20 to install the delineator post 10 on the ground.

If the delineator post 10 according to the first embodiment of the present disclosure is installed as above, when a vehicle hits the delineator body 30 so that the delineator body 30 is tilted or when a tire of a vehicle tramples the delineator body 30 so that the delineator body 30 is laid down, the protrusion 21 of the base panel 20 is pulled out from the open lower portion of the delineator body 30. In addition, if an external force applied to the delineator body 30 is released, the delineator body 30 restores its original shape by means of elasticity of the restoration rod 40 as well as the first elastic member 50 and the second elastic member 60 so that the protrusion 21 of the base panel 20 is inserted into the open lower portion of the delineator body 30.

Figure 6:
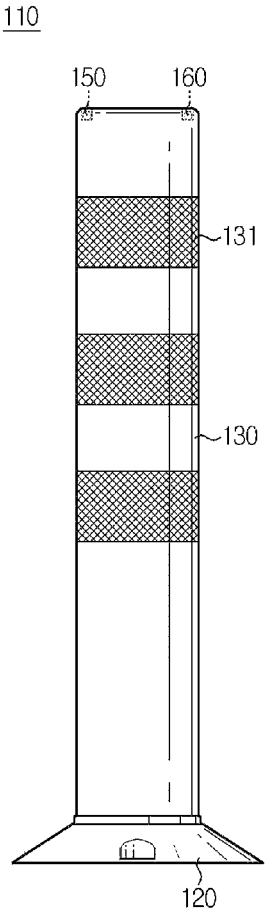
FIG. 6 is a front view showing a delineator post having a restoration function according to the second embodiment of the present disclosure.
Figure 7:
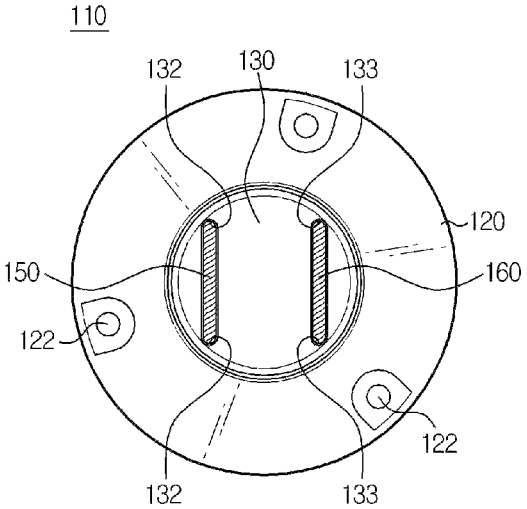
FIG. 7 is a plane view showing the delineator post having a restoration function according to the second embodiment of the present disclosure.
Figure 8:
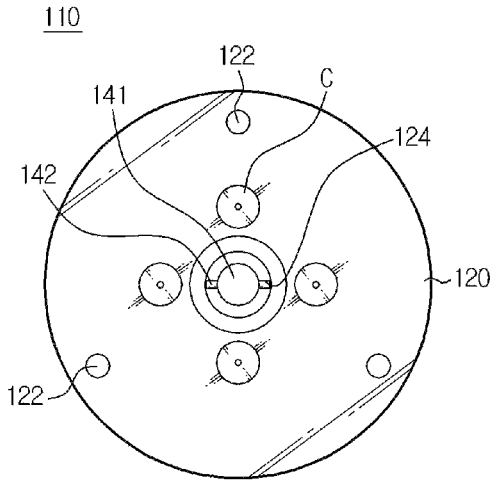
FIG. 8 is a bottom view showing the delineator post having a restoration function according to the second embodiment of the present disclosure.

FIG. 6 is a front view showing a delineator post having a restoration function according to the second embodiment of the present disclosure, FIG. 7 is a plane view showing the delineator post having a restoration function according to the second embodiment of the present disclosure, and FIG. 8 is a bottom view showing the delineator post having a restoration function according to the second embodiment of the present disclosure.

Figure 9:
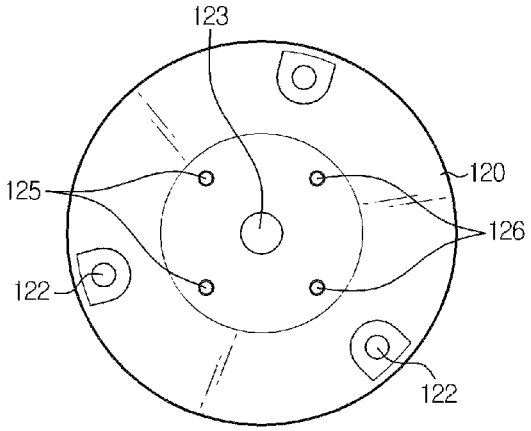
FIG. 9 is a plane view showing a base panel employed in the delineator post having a restoration function according to the second embodiment of the present disclosure.
Figure 10:
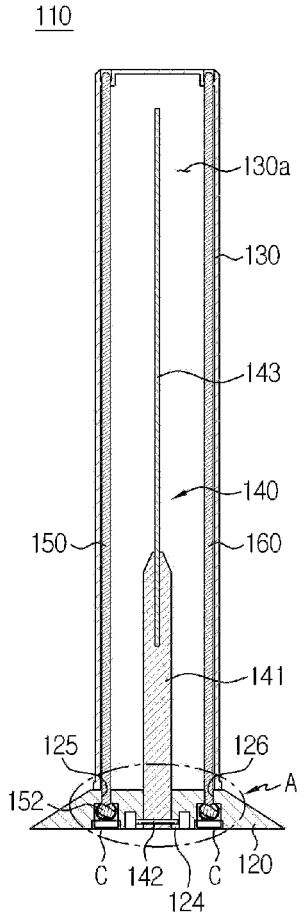
FIG. 10 is a cross-sectional view showing the delineator post having a restoration function according to the second embodiment of the present disclosure.
Figure 11:
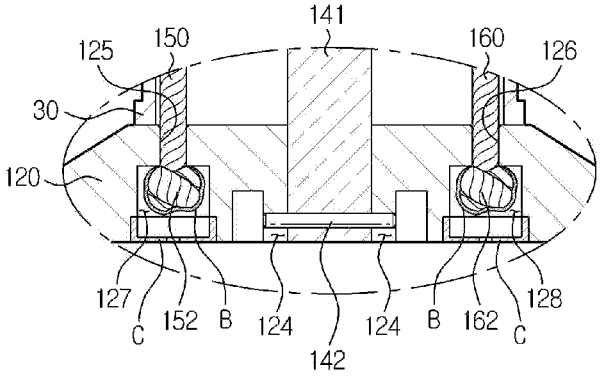
FIG. 11 is an enlarged view showing the portion A of FIG. 10.

Also, FIG. 9 is a plane view showing a base panel employed in the delineator post having a restoration function according to the second embodiment of the present disclosure, FIG. 10 is a cross-sectional view showing the delineator post having a restoration function according to the second embodiment of the present disclosure, and FIG. 11 is an enlarged view showing the portion A of FIG. 10.

Referring to FIGS. 6 to 11, a delineator post 110 having a restoration function according to the second embodiment of the present disclosure is installed on a road to control entry of vehicles and includes a base panel 120, a delineator body 130, and/or a restoration rod 140.

The delineator post 110 having a restoration function according to the second embodiment of the present disclosure is different from the delineator post 110 having a restoration function according to the first embodiment of the present disclosure in that the base panel 120 and the delineator body 130 are connected by using an elastic member. Hereinafter, the delineator post 110 having a restoration function according to the second embodiment of the present disclosure will be described based on differences from the delineator post 110 having a restoration function according to the first embodiment of the present disclosure.

The base panel 120 is made of synthetic resin. A plurality of fixing holes 122 are formed at a periphery of the base panel 120 so that anchor bolts may be coupled thereto. Therefore, the base panel 120 may be fixed to the ground by coupling anchor bolts to the plurality of fixing holes 122.

A coupling hole 123 is formed at the center of the base panel 120 through a top surface and a bottom surface of the base panel 120. At least one fixing groove 124 is formed at the bottom surface of the base panel 120 by cutting a part of the base panel 120 to communicate with the coupling hole 123.

The delineator body 130 is made of synthetic resin. The lower portion of the delineator body 130 is open. A disposition space 130*a* is formed in the delineator body 130. A plurality of reflecting strips 131 are attached to an outer circumference of the delineator body 130. A driver may recognize the delineator post 110 by means of light of a vehicle or the like, reflected by the plurality of reflecting strips 131.

The restoration rod 140 is made of synthetic resin of urethane material with a restoring property and/or an elastic property. A protrusion 141 is formed on an upper portion of the restoration rod 140 to protrude above the base panel 120 through the coupling hole 123 of the base panel 120, so that the protrusion 141 may be inserted into the disposition space 130*a* of the delineator body 130. The lower portion of the restoration rod 140 is coupled to the coupling hole 123 of the base panel 120. The restoration rod 140 may restore the delineator body 130 tilted by an external force.

In addition, a fixing pin 142 is coupled to the lower portion of the restoration rod 140 so that the fixing pin 142 is inserted into and hooked by at least one fixing groove 124 of the base panel 120. The restoration rod 140 may be formed together with the fixing pin 142 by insert molding so that the fixing pin 142 vertically passes the lower portion of the restoration rod 140, without being limited thereto. Since the fixing pin 142 is provided as above, the restoration rod 140 may be separated from the base panel 120 by pulling out the fixing pin 142 of the restoration rod 140, inserted into and hooked by the fixing groove 124 of the base panel 120, below the base panel 120, thereby ensuring easy maintenance.

In addition, an elastic rod 143 may be coupled to the upper portion of the restoration rod 140, and the elastic rod 143 may be formed by impregnating a composite material with synthetic resin and give an elastic force to restore the delineator body 130 tilted by an external force by assisting the protrusion 141. The kinds of the composite material are not specially limited, and for example, glass fiber may be used.

If the protrusion 141 is inserted into the disposition space 130*a* of the delineator body 130 longer, the protrusion 141 deforms greater by the delineator body 130 as much, which may result in plastic deformation of the protrusion 141. To solve this problem, the protrusion 141 is formed with a relatively short length, and the elastic rod 143 stronger than the protrusion 141 and capable of giving elasticity to assist the protrusion 141 is coupled to the upper portion of the protrusion 141. The restoration rod 140 may be formed by insert molding together with the elastic rod 143 so that the lower portion of the elastic rod 143 may be buried in the protrusion 141 to a predetermined depth, without being limited thereto. Since the elastic rod 143 is provided as above, it is possible to prevent the protrusion 141 from plastically deforming due to an external force, which may improve durability of the delineator post 110.

Meanwhile, the restoration rod 140 may restore the delineator body 130 tilted by an external force, but if a strong external force is applied, the protrusion 141 and the elastic rod 143 of the restoration rod 140 may deviate from the disposition space 130*a* of the delineator body 130. If the protrusion 141 and the elastic rod 143 of the restoration rod 140 deviates from the disposition space 130*a* of the delineator body 130, the restoration rod 140 is not able to restore the delineator body 130 anymore.

To solve this problem, the delineator post 110 having a restoration function according to the second embodiment of the present disclosure may further include at least one elastic member accommodated in the disposition space 130*a* of the delineator body 30 and elastically connecting the base panel 120 to the delineator body 130. The number of elastic members, which may be installed at the delineator post 110, is not specially limited. Hereinafter, it will be described as an example that two elastic members, namely a first elastic member 150 and a second elastic member 160, are installed.

In order to install the first elastic member 150, a pair of first connection holes 132 may be formed through the upper portion of the delineator body 130 to communicate with the disposition space 130*a*, and a pair of first coupling holes 125 may be formed through the base panel 120. The first elastic member 150 may have one end fixed to any one of the pair of first coupling holes 125 through any one of the pair of first connection holes 132, and the other end fixed to the other of the pair of first coupling holes 125 through the other of the pair of first connection holes 132, in order to connect the pair of first connection holes 132. In other words, the first elastic member 150 may be bent into a U shape so that a central bent portion is supported by the top surface of the delineator body 130, and both ends of the first elastic member 150 may be fixed to the pair of first coupling holes 125, respectively, to elastically connect the delineator body 130 to the base panel 120.

The first elastic member 150 may be installed in any way. For example, a pair of first accommodation holes 127 may be formed in the bottom surface of the base panel 120 to communicate with the pair of first coupling holes 125, and both ends of the first elastic member 150 may extend to the pair of first accommodation holes 127 through the pair of first coupling holes 125, respectively. In addition, both ends of the first elastic member 150 may be knotted to form a pair of first knot 152 so that both ends of the first elastic member 150 extending to the pair of first accommodation holes 127 through the pair of first coupling holes 125 do not deviate through the pair of first coupling holes 125. In other words, the pair of first knot 152 having a greater diameter than the pair of first coupling holes 125 is formed at both ends of the first elastic member 150 extending to the pair of first accommodation holes 127.

In addition, in order to form the pair of first knots 152 in an easy way, a plurality of yarn fibers with elasticity may be braided to form an elastic rope, and this elastic rope may be used as the first elastic member 150. In addition, an adhesive B may be applied to an outer side of the first knot 152 to prevent the first knot 152 from being untied, and covers C may be mounted respectively to lower portions of the pair of first accommodation holes 127 to protect the first knot 152 from the outside.

Since the first elastic member 150 is installed as above, the pair of first knot 152 is hooked by the pair of first coupling holes 125, and thus it is possible to prevent both ends of the first elastic member 150 from deviating through the pair of first coupling holes 125, respectively. Therefore, the first elastic member 150 may be firmly installed not to be separated from the base panel 120.

In order to install the second elastic member 160, a pair of second connection holes 133 may be formed through the upper portion of the delineator body 130 to communicate with the disposition space 130*a*, and a pair of second coupling holes 126 may be formed through the base panel 120. The second elastic member 160 may have one end fixed to any one of the pair of second coupling holes 126 through any one of the pair of second connection holes 133 and the other end fixed to the other of the pair of second coupling holes 126 through the other of the pair of second connection holes 133, in order to connect the pair of second connection holes 133. In other words, the second elastic member 160 may be bent into a U shape so that its central bent portion is supported by the top surface of the delineator body 130, and both ends of the second elastic member 160 may be fixed to the pair of second coupling holes 126, thereby elastically connecting the delineator body 130 to the base panel 120.

The second elastic member 160 may be installed in any way. For example, a pair of second accommodation holes 128 may be formed in the bottom surface of the base panel 120 to communicate with the pair of second coupling holes 126, and both ends of the second elastic member 160 may extend to the pair of second accommodation holes 128 through the pair of second coupling holes 126. The second elastic member 160 may include a pair of second knots 162 by knotting both ends thereof so that both ends extending to the pair of second accommodation holes 128 through the pair of second coupling holes 126 do not deviate through the pair of second coupling holes 126. In other words, the pair of second knots 162 having a greater diameter than the pair of second coupling holes 126 is formed at both ends of the second elastic member 160 extending to the pair of second accommodation holes 128.

In addition, in order to form the pair of second knots 162 in an easy way, a plurality of yarn fibers with elasticity may be braided to form an elastic rope, and this elastic rope may be used as the second elastic member 160. In addition, an adhesive B may be applied to an outer side of the second knots 162 to prevent the second knots 162 from being untied, and covers C may be mounted respectively to lower portions of the pair of second accommodation holes 128 to protect the second knots 162 from the outside.

Since the second elastic member 160 is installed as above, the pair of second knots 162 is hooked by the pair of second coupling holes 126, and thus it is possible to prevent both ends of the second elastic member 160 from deviating through the pair of second coupling holes 126, respectively. Therefore, the second elastic member 160 may be firmly installed not to be separated from the base panel 120.

Hereinafter, an installation process of the delineator post 110 configured as above according to the second embodiment of the present disclosure will be described.

First, anchor bolts are installed at the ground.

Next, the delineator body 130 is disposed at the top surface of the base panel 120 so that the protrusion 141 and the elastic rod 143 of the restoration rod 140 are inserted into the disposition space 130*a* of the delineator body 130.

After that, the base panel 120 and the delineator body 130 are connected by means of the first and second elastic members 150, 160, and then the first and second knots 152, 162 are formed at both ends of the first and second elastic members 150 160 to fix the first and second elastic members 150, 160 to the base panel 120.

Next, anchor bolts are connected to the fixing hole 122 of the base panel 120 to install the delineator post 110 on the ground.

In case the delineator post 110 according to the second embodiment of the present disclosure is installed as above, when a vehicle hits the delineator body 130 so that the delineator body 130 is tilted or when a tire of a vehicle tramples the delineator body 130 so that the delineator body 130 is laid down, if the external force applied to the delineator body 130 is released, the delineator body 130 restores its original shape by means of elasticity of the restoration rod 140 as well as the first elastic member 150 and the second elastic member 160.

The present disclosure has been described in detail. However, it should be understood that the detailed description and specific examples, while indicating embodiments of the disclosure, are given by way of illustration only, since various changes and modifications within the scope of the disclosure will become apparent to those skilled in the art from this detailed description

What is claimed is:

1. A delineator post, comprising:

a base panel;

a delineator body fixed to the base panel and having a disposition space formed therein; and a restoration rod having an upper portion disposed in the disposition space of the delineator body and a lower portion coupled to the base panel, the restoration rod being capable of restoring the delineator body when tilted by an external force; and at least one elastic member extending through the disposition space and elastically connecting the base panel and the delineator body, wherein the delineator body comprises first and second connection holes formed through an upper portion thereof, wherein the base panel further comprises first and second coupling holes, wherein the at least one elastic member comprises a first end portion fixed to the first coupling hole and a second end portion fixed to the second coupling hole, the at least one elastic member extending from the first coupling hole to the second coupling hole through the first connection hole and the second connection hole, wherein each of the first and second coupling holes comprise a threaded inner wall, and wherein the at least one elastic member has a tubular shape, wherein the first end portion is inserted in the first coupling hole and a first screw is inserted in the first coupling hole such that the first end portion is interposed between the threaded inner wall of the first coupling hole and the first screw so as to fix the first end portion to the first coupling hole, wherein the second end portion is inserted in the second coupling hole and a second screw is inserted in the second coupling hole such that the second end portion is interposed between the threaded inner wall of the second coupling hole and the second screw so as to fix the second end portion to the second coupling hole.

2. The delineator post with a restoration function according to claim 1, wherein the first and second end portions of the at least one elastic member extend through the first and second coupling holes, respectively.

3. The delineator post with a restoration function according to claim 1, wherein the base panel comprises a joining hole configured to receive the lower portion of the restoration rod, wherein the base panel further includes an extension provided at a bottom surface thereof and formed with a tilted groove structure communicating with the joining hole, and wherein the restoration rod includes a hooking portion provided at the lower portion thereof and having a tilted outer side to be hooked by the extension.

4. The delineator post with a restoration function according to claim 1, wherein the base panel comprises a joining hole configured to receive the lower portion of the restoration rod, wherein the base panel further includes at least one fixing groove provided at a bottom surface thereof and formed by cutting a part of the base panel to communicate with the joining hole, and wherein the restoration rod includes a fixing pin coupled to a lower portion thereof and inserted into and hooked by the at least one fixing groove.

5. The delineator post with a restoration function according to claim 1, wherein the base panel further includes a protrusion formed at a top surface thereof and inserted into the delineator body.

6. The delineator post with a restoration function according to claim 1, wherein an elastic rod is coupled to an upper portion of the restoration rod to give an elastic force for restoring the delineator body when tilted by an external force.

7. The delineator post with a restoration function according to claim 6, wherein the restoration rod is made of synthetic resin of urethane material, and wherein the elastic rod is formed by impregnating a composite material with synthetic resin.

8. The delineator post with a restoration function according to claim 7, wherein the composite material is glass fiber.

9. A delineator post with a restoration function comprising:

a base panel having a coupling hole formed therethrough and installed at the ground;

a delineator body installed at an upper portion of the base panel and having a disposition space formed therein;

a restoration rod having an upper portion inserted into the disposition space of the delineator body through the coupling hole and a lower portion coupled to the coupling hole, the restoration rod being capable of restoring the delineator body tilted by an external force; and at least one elastic member accommodated in the disposition space of the delineator body to elastically connect the base panel to the delineator body, wherein the delineator body includes at least one pair of connection holes formed through an upper portion thereof to communicate with the disposition space, wherein the base panel further includes at least one pair of coupling holes formed therethrough, wherein the at least one elastic member has one end fixed to any one of the at least one pair of coupling holes through any one of the at least one pair of connection holes and the other end fixed to the other one of the at least one pair of coupling holes through the other one of the at least one pair of connection holes, wherein the at least one elastic member is made of elastic hoses whose both ends are insertable into the at least one pair of coupling holes, and screw portions are respectively formed at inner sides of the at least one pair of coupling holes so that screws may be coupled thereto, and wherein screws are respectively coupled to the at least one pair of coupling holes so that both ends of the at least one elastic member inserted into the at least one pair of coupling holes are interposed between the at least one pair of coupling holes and the screws, thereby fixing both ends of the at least one elastic member to the at least one pair of coupling holes, respectively.

* * * * *